US008328011B2

(12) United States Patent
Skurdalsvold et al.

(10) Patent No.: US 8,328,011 B2
(45) **Date of Patent: *Dec. 11, 2012**

(54) WINDSHIELD WIPER PACKAGING

(75) Inventors: Scott Alan Skurdalsvold, Mansfield, TX (US); Michael Todd Lindars, Portland, OR (US)

(73) Assignee: Jamak Fabrication-Tex, LLC, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/978,135

(22) Filed: Dec. 23, 2010

(65) Prior Publication Data

US 2011/0233087 A1 Sep. 29, 2011

Related U.S. Application Data

(63) Continuation of application No. 12/258,853, filed on Oct. 27, 2008, now Pat. No. 7,857,133.

(60) Provisional application No. 61/000,572, filed on Oct. 27, 2007, provisional application No. 61/081,320, filed on Jul. 16, 2008.

(51) Int. Cl.
*B65D 85/68* (2006.01)

(52) U.S. Cl. ..... 206/335; 206/468; 206/1.5; 206/806

(58) Field of Classification Search ..... 206/349, 206/468, 467, 774, 335, 1.5, 806; 220/345.2, 220/345.3

See application file for complete search history.

(56) References Cited

U.S. PATENT DOCUMENTS

| | | | |
|---|---|---|---|
| 1,797,419 | A | 3/1931 | Hothersall |
| 2,102,094 | A | 12/1937 | Romig |
| 2,229,039 | A | 1/1941 | Brabant |
| 3,382,972 | A | 5/1968 | Phipps |
| D216,251 | S | 12/1969 | Offray, Jr. |
| 3,530,978 | A | 9/1970 | Lewandowski |
| 3,658,177 | A | 4/1972 | Saunders |
| 3,782,584 | A | 1/1974 | Swenson et al. |

(Continued)

FOREIGN PATENT DOCUMENTS

EP 1176070 1/2002

OTHER PUBLICATIONS

Non-Final Office Action date mailed Apr. 2, 2010 for U.S. Appl. No. 12/258,853.

(Continued)

*Primary Examiner* — Jacob K Ackun
*Assistant Examiner* — Jenine Pagan
(74) *Attorney, Agent, or Firm* — Patton Boggs LLP

(57) ABSTRACT

A windshield wiper package for containing a windshield wiper includes a front portion having a recess for receiving the windshield wiper, a back portion connected to the front portion for containing the windshield wiper within the recess, and an opening disposed in the back portion to allow loading or unloading of the windshield wiper. The opening is sized such that a length of the opening is less than about one-third of a length of the wiper package. A door is slidingly received by the back portion such that the door can be moved between an open position and a closed position. Complimentary detents and indentations are provided for securing the door in the open position or the closed position, the detents being positioned on one of the back portion and the door, and the indentations being positioned on another of the back portion and door.

13 Claims, 14 Drawing Sheets

U.S. PATENT DOCUMENTS

| | | | | | |
|---|---|---|---|---|---|
| 3,812,963 | A | * | 5/1974 | Zahuranec et al. | 206/468 |
| 4,007,828 | A | * | 2/1977 | Mayled | 206/1.5 |
| 4,120,400 | A | | 10/1978 | Kotyuk | |
| 4,175,660 | A | | 11/1979 | Feibelman | |
| 4,284,204 | A | * | 8/1981 | Carey, Jr. | 220/345.3 |
| 4,561,544 | A | * | 12/1985 | Reeve | 206/540 |
| 5,027,947 | A | | 7/1991 | Reighart | |
| 5,129,538 | A | | 7/1992 | Bennett | |
| 5,160,026 | A | * | 11/1992 | Marsh | 206/373 |
| 5,275,291 | A | * | 1/1994 | Sledge | 206/531 |
| 5,356,011 | A | | 10/1994 | Romick | |
| 5,899,334 | A | | 5/1999 | Domerchie et al. | |
| 6,168,020 | B1 | * | 1/2001 | Niedzwiedz | 206/468 |
| 6,247,590 | B1 | | 6/2001 | Baker | |
| 6,279,746 | B1 | | 8/2001 | Hussaine et al. | |
| 6,431,354 | B1 | | 8/2002 | Irisawa | |
| 6,523,689 | B2 | | 2/2003 | Mickel | |
| 7,857,133 | B2 | | 12/2010 | Skudalsvold et al. | |
| 2005/0082185 | A1 | * | 4/2005 | Lee | 206/335 |
| 2006/0213799 | A1 | | 9/2006 | Muller | |

OTHER PUBLICATIONS

Response filed Aug. 2, 2010 for U.S. Appl. No. 12/258,853.
Notice of Allowance date mailed Oct. 15, 2010 for U.S. Appl. No. 12/258,853.
International Search Report and Written Opinion date mailed Dec. 12, 2008; International Application No. PCT/US2008/081339.

* cited by examiner

WINDSHIELD WIPER PACKAGING

CROSS-REFERENCE TO RELATED APPLICATIONS

This application is a continuation of U.S. patent application Ser. No. 12/258,853, filed Oct. 27, 2008, now U.S. Pat. No. 7,857,133 which claims the benefit of U.S. Provisional Application No. 61/000,572, filed Oct. 27, 2007, and U.S. Provisional Application No. 61/081,320, filed Jul. 16, 2008, all of which are incorporated herein by reference.

BACKGROUND

1. Field of the Invention

The invention relates generally to packaging and more specifically to methods and systems for packaging elongated articles such as windshield wipers.

2. Description of Related Art

Rain, sleet, and snow have always presented a vision problem for the driver of a moving vehicle. The windshield wiper blade has attempted to minimize the problem by clearing the windshield of the light obstructing moisture and debris. Such blades are typically formed of rubber, silicone, or other elastomeric materials. Over the years, wiper blades have been modified in many ways in order to enhance wipe quality and therefore visibility during precipitation. In some instances, the configuration of the blade has been changed to give a plurality of contact surfaces on the blade. Various modifications have been introduced to improve the consistency and integrity of the wiping edge.

Packaging of windshield wipers also presents challenging issues. Since windshield wiper blades are elongated, it has typically been desired to provide packaging that allows the package and wiper to hang from a store wall or shelf. Problems with some existing wiper packaging is that the packaging does not adequately secure the wipers during shipping and storage in a retail environment. Wipers and other contents sometimes inadvertently fall out of the packages which may cause damage to the wipers and greater expense due to the time required for a retailer to re-load the contents of the packaging. To combat this issue, some wiper manufacturers have moved to a radio frequency (RF), ultrasonic, or heat-sealed blister package which substantially prevents inadvertent loss of the packaging contents. The problem with these particular packages is that the packages are extremely difficult to open by consumers. Many of these packages require that the consumer use a knife or scissors to open the package, and this has resulted in an increase in injuries to consumers, caused by other the cutting tool or the sharp plastic shards created when the package is opened.

SUMMARY

The problems presented by existing packaging for windshield wipers and other elongated articles are solved by the systems and methods of the illustrative embodiments described herein. In one illustrative embodiment, a windshield wiper package for containing a windshield wiper is provided. The wiper package includes a front portion having a recess for receiving the windshield wiper and a back portion connected to the front portion for containing the windshield wiper within the recess. An opening is disposed in the back portion to allow loading or unloading of the windshield wiper, and the opening is sized such that a length of the opening is less than about one-third of a length of the wiper package. A door is slidingly received by the back portion such that the door can be moved between an open position and a closed position. Complimentary detents and indentations are provided for securing the door in the open position or the closed position. The detents are positioned on one of the back portion and the door, and the indentations are positioned on another of the back portion and door.

In another illustrative embodiment, a windshield wiper package is provided for containing a windshield wiper. The package includes a cavity for receiving the windshield wiper, and the cavity has a plurality of walls. At least one of the walls is a lower wall that is capable of supporting the windshield wiper when the package is oriented in an upright position. A backing member is provided to substantially enclose the cavity, and an opening is disposed in the backing member at a bottom end of the backing member to allow loading or unloading of the windshield wiper. The opening is positioned on the backing member to form a retaining lip between the opening and the lower wall. A door is slidingly received by the backing member and is capable of sliding between an open position and a closed position. Locking means are associated with the door and the backing member to substantially secure the door in the open position or the closed position. The retaining lip provides a barrier to substantially prevent inadvertent unloading of the windshield wiper through the opening when the package is in the upright position.

In still another embodiment, a windshield wiper package for containing a windshield wiper includes a front portion having a recess for receiving the windshield wiper and a back portion connected to the front portion to contain the windshield wiper within the recess. At least one of the back portion and the front portion includes a perimeter edge with a pair of substantially parallel longitudinal sides. An opening is disposed in the back portion at a bottom end of the back portion to allow loading or unloading of the windshield wiper. A door is provided and includes a plurality of hook members, each of the hook members configured to engage one of the pair of substantially parallel longitudinal sides such the door is slidingly received on the pair of substantially parallel longitudinal sides. The door is configured to be moved in a track region of the substantially parallel longitudinal sides between an open position and a closed position. A lower indentation is disposed on the back portion proximate a bottom end of the opening, and an intermediate indentation is disposed on the back portion proximate an upper end of the opening. The intermediate indentation includes a substantially rectangular cubical region having an inclined exit surface on a side of the substantially rectangular cubical region nearest the upper indentation. An upper indentation is disposed on the back portion such that the intermediate indentation is positioned substantially between the upper indentation and the lower indentation. The upper indentation includes a substantially rectangular cubical region having an inclined exit surface on a side of the substantially rectangular cubical region nearest the intermediate indentation. A lower detent is disposed on the door and is configured to engage the lower indentation when the door is in the closed position and the intermediate indentation when the door is in the open position. An upper detent is disposed on the door and is configured to engage the intermediate indentation when the door is in the closed position and the upper indentation when the door is in the open position.

Other objects, features, and advantages of the invention will become apparent with reference to the drawings, detailed description, and claims that follow.

DETAILED DESCRIPTION OF THE ILLUSTRATIVE EMBODIMENTS

Figure 1:
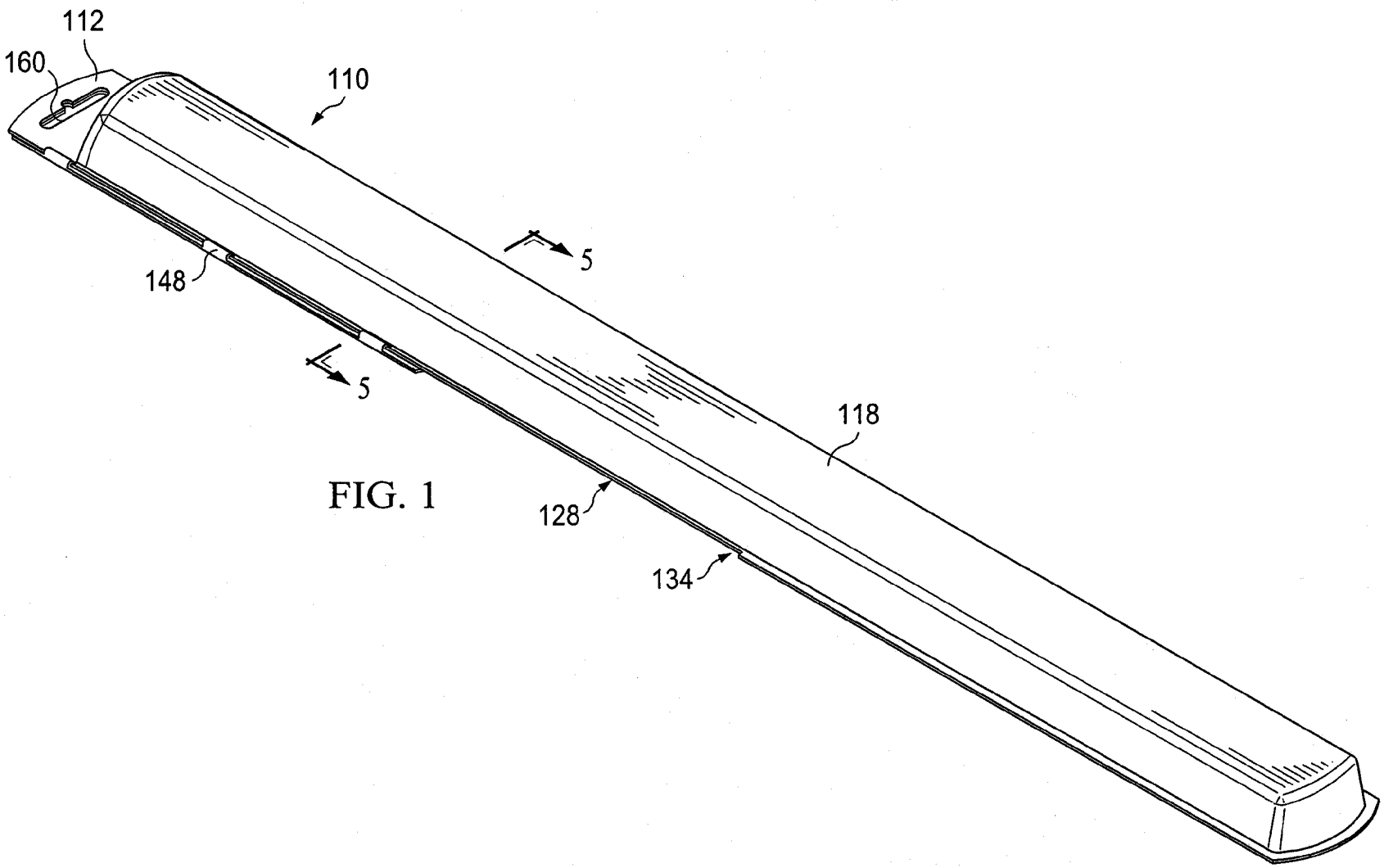
FIG. 1 illustrates a front perspective of a package for an elongated article according to an illustrative embodiment of the invention.

In the following detailed description of several illustrative embodiments, reference is made to the accompanying drawings that form apart hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

The several embodiments described herein relate to a generally elongated package, carton, or container for which a width of the package is substantially less than a length of the package. Reference to the width of the packages described herein is meant to describe a dimension of the package that is substantially perpendicular to the length of the package. As an example of this relationship, in FIG. 3, the width is depicted by W, and the length is represented by L.

Referring to FIGS. 1-7, an improved windshield wiper package 110 according to an embodiment of the present invention is provided and includes an elongated front portion 112 connected to an elongated back portion 114. Front portion 112 includes a molded cavity, or recess 118 to receive a windshield wiper that is carried by the wiper package 110. Preferably, the front portion 112 is a blister container that is molded or otherwise formed from a plastic or other material. The material used to form the front portion 112 may be transparent to allow display of the package contents. The back portion 114 is preferably also made from a plastic or other material. This material may also be transparent, or alternatively may be translucent or opaque.

An opening 122 is provided at a top end of the back portion 114. A perimeter edge 124 of the back portion 114 includes a track region 128 that is recessed relative to portions of the perimeter edge 124 outside of the track region 128. The width of the wiper package 110 in the track region 128 is less than the width of the wiper package 110 outside of the track region 128. A track 132 is provided in the track region 128 proximate the perimeter edge 124. In one embodiment, the track 132 is substantially cylindrical in shape and is formed by rolling at least one of the front portion 112 and the back portion 114 in the area of the track region 128 (see FIG. 6). In another embodiment illustrated in FIG. 7, the track 132 might not be raised, but instead may by the perimeter edge 124 itself within the track region 128. Each of the track regions 128 further includes a pair of shoulders 134 that define the boundaries of the track region 128.

Figure 3:
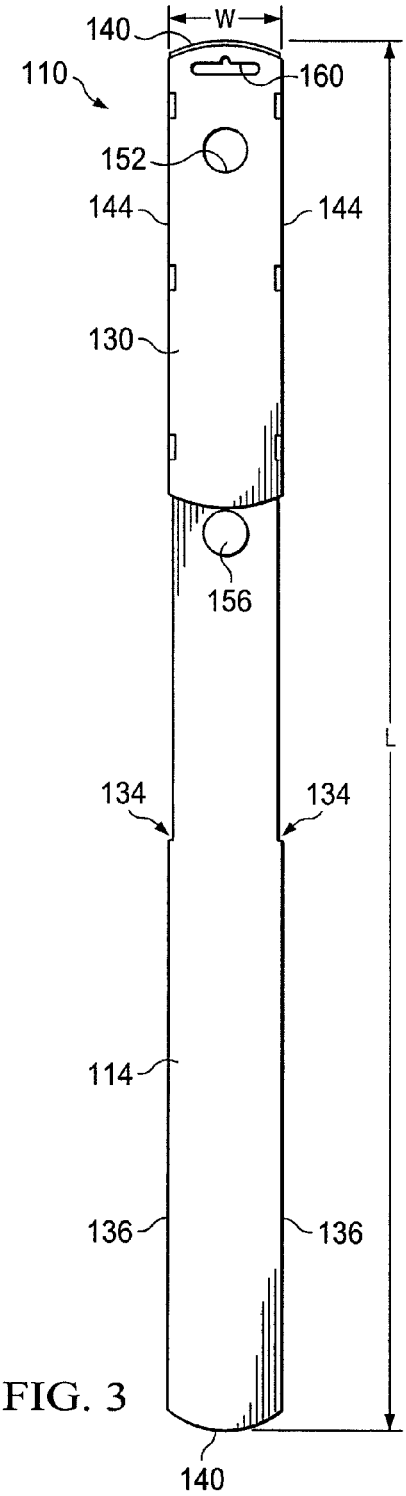
FIG. 3 illustrates a rear view of the package of FIG. 1 with a door of the package being shown in a closed position.
Figure 4:
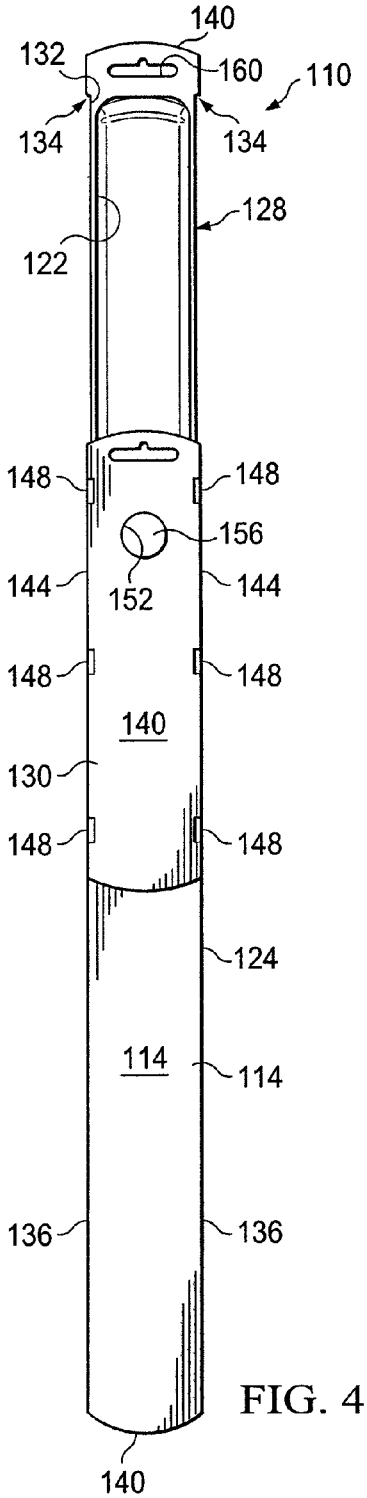
FIG. 4 depicts a rear view of the package of FIG. 1 with a door of the package being shown in an open position.

Referring more specifically to FIGS. 3 and 4, the length, L, of wiper package 110 is substantially greater than the width, W, of the wiper package 110. The perimeter edge 124 preferably includes a pair of longitudinal sides 136 and a pair of lateral sides 140 arranged in a substantially rectangular fashion. The track region 128 is located along each of the longitudinal sides 136. The opening 122 preferably does not extend beyond the longitudinal placement of the track region 128, and the opening 122 is sized in length to preferably be smaller than the length of the track region 128.

Figure 2:
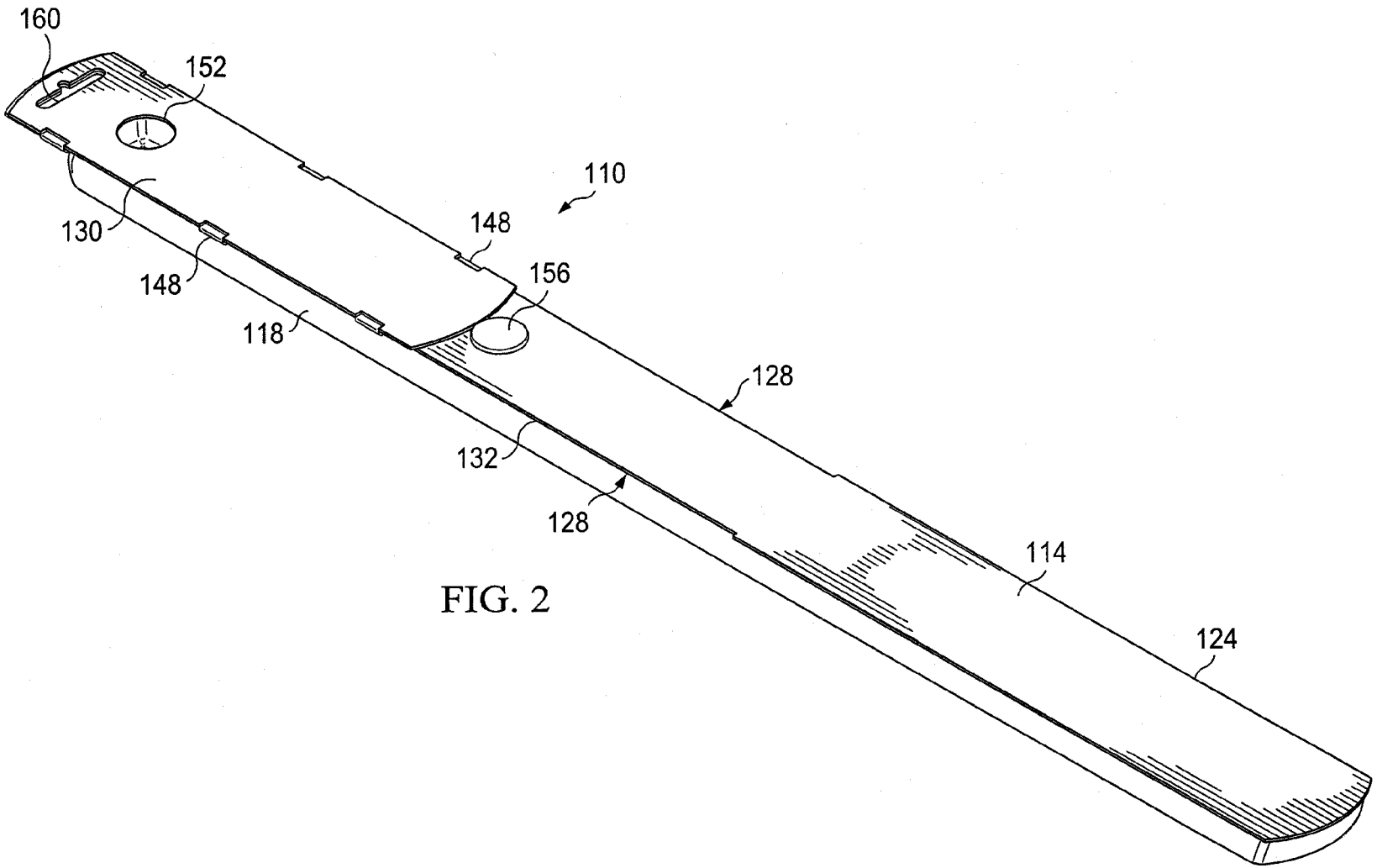
FIG. 2. depicts a rear perspective view of the package of FIG. 1.

A door 130 is slidingly received on the wiper package 110 to allow the recess 118 to be selectively accessed through the opening 122. FIGS. 2 and 3 illustrate the door 120 in a closed position, while FIG. 4 illustrates the door 120 in an open position. The door 120 may include a substantially planar member 140 having a width that is about equal to the width of the front and back portions 112, 114 outside of the track region 128. The door 130 may include a pair of substantially parallel longitudinal edges 144, along which are positioned at least one hook member 148. In one embodiment, a plurality of spaced-apart hook members 148 may be disposed along each longitudinal edge 144 above an upper surface of the front portion 112. The hook members 148 are slidingly received by the track 132 so that the door 130 is secured proximate the back portion 114 of the wiper package 110, yet allowed to slide along the longitudinal sides 136 within the track region 128. When the hook members 148 of the door 130 are engaged to the track 132, the door is capable of sliding between the closed position and the open position along the track 132. The shoulders 134 of the track region 128 act as stops and prevent the door 130 from sliding outside the track region 128.

Figure 5:
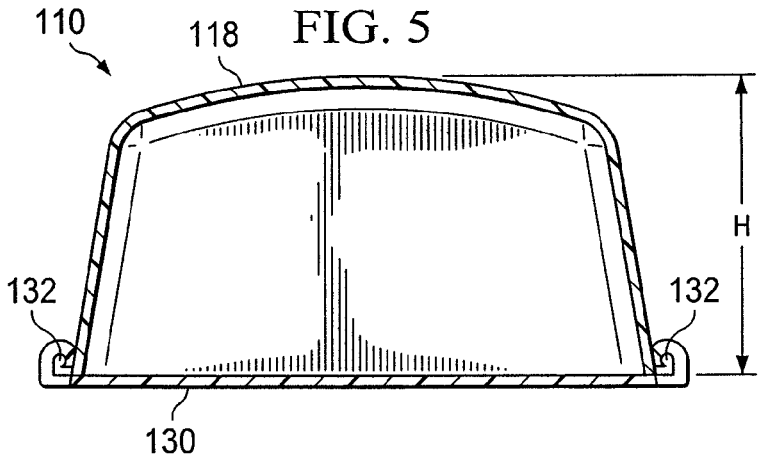
FIG. 5 illustrates a cross-sectional view of the package of FIG. 1 taken at 5-5.
Figure 6:
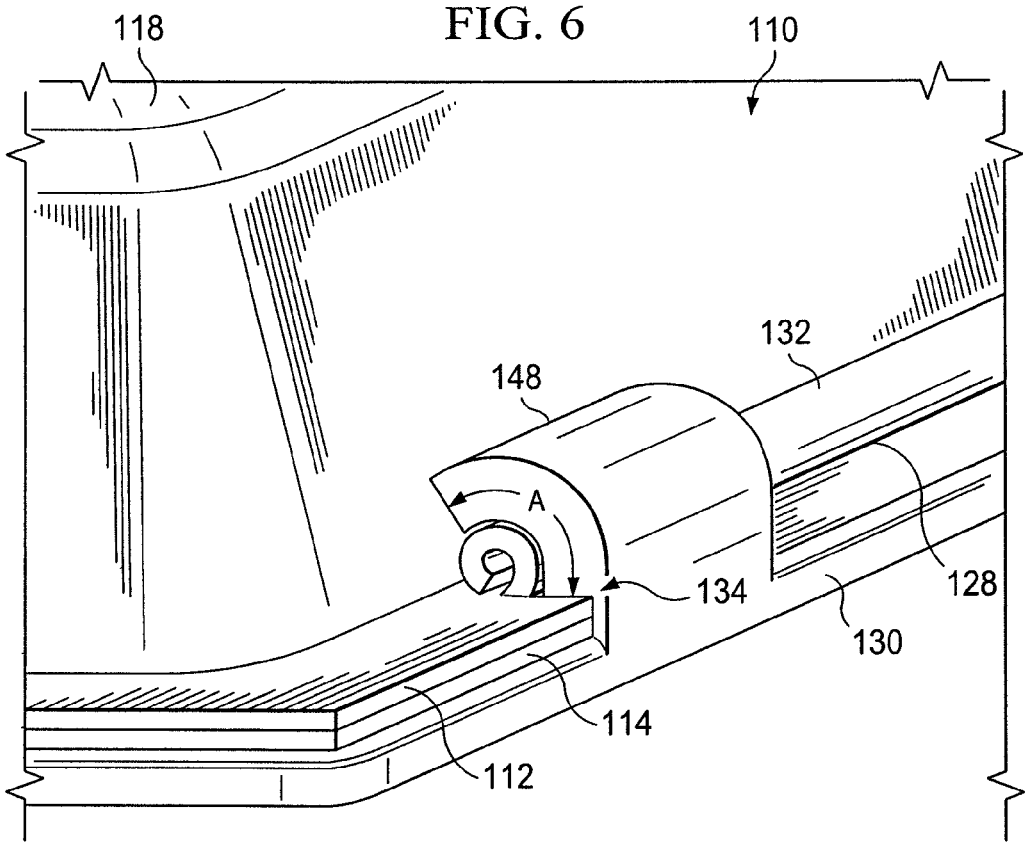
FIG. 6 depicts an enlarged perspective view of a portion of the package of FIG. 1, the package having a hook member according to an illustrative embodiment.

Referring more specifically to FIGS. 5 and 6, the hook members 148 may have a cross-section (taken in a plane normal to the longitudinal sides 136 and illustrated in FIG. 5) that is substantially arcuate in shape. While the hook members 148 may not be fully cylindrical, preferably each hook member 148 subtends an arc that is ninety (90) degrees or greater. In one embodiment shown in FIG. 6, the arc subtended by the hook member 148 is represented by angle, A, and is greater than ninety degrees. One advantage of the hook members 148 subtending an arc greater than ninety degrees is that the door 130 is more securely fastened to the track 132, which prevents the door 130 from becoming easily dislodged from the track 132.

Figure 7:
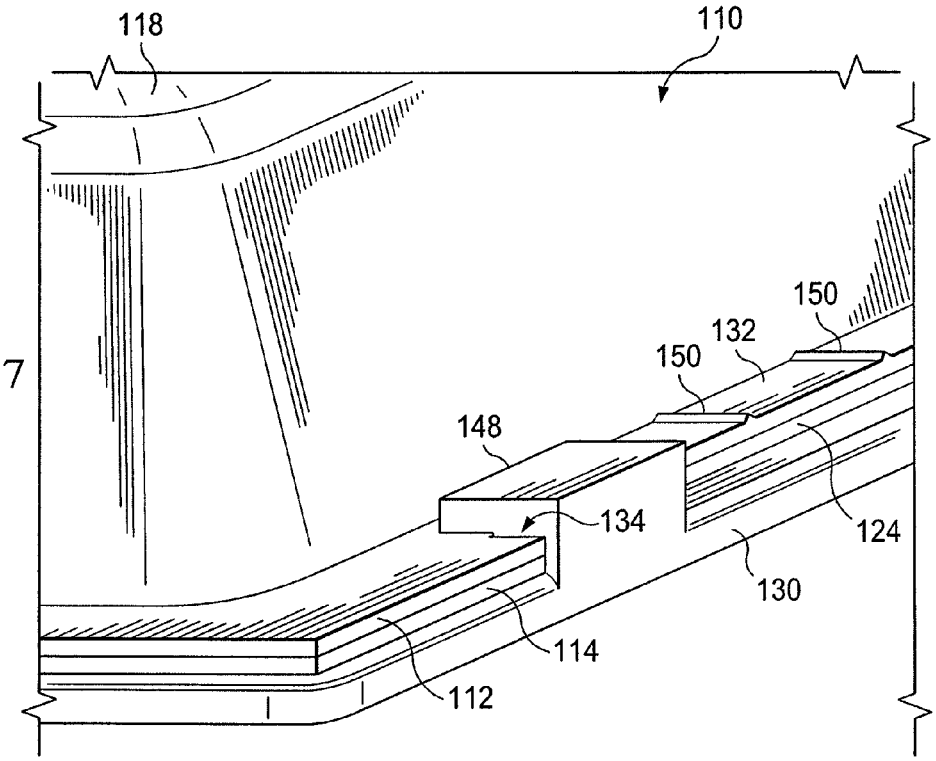
FIG. 7 illustrates an enlarged perspective view of a portion of the package of FIG. 1, the package having a hook member according to an illustrative embodiment.

Referring to FIG. 7, in one embodiment, the hook member 148 may have a substantially L-shaped cross section, and the track 132 may simply be defined by the edge of the front and back portions 112, 114 in the track region 128. In other words, in this particular embodiment, the front and back portions 112, 114 are simply notched to provide a recessed edge in the track region 128, as opposed to being rolled as in the embodiment of FIG. 6. The track 132 may include ridges 150, or alternatively indentations, that cooperate with the hook members 148 to prevent unintentional sliding of the door 130. Alternatively, a friction fit between the track 132 and the hook members 148 may prevent unintentional sliding. While the cross-sectional shapes of the hook members 148 have been described as being arcuate (i.e. rounded) or L-shaped, any suitable cross-sectional shape could be employed, including without limitation, C-shaped, U-shaped, Z-shaped, or semi-elliptical cross-sections.

An aperture 152 is provided in the door 130 to provide easy gripping of the door 130 when the door is moved from the closed position (FIG. 3) to the open position (FIG. 4), and vice versa. A raised locking region 156 may be disposed on the back portion 114 that is similar in shape to the aperture 152. When the door 130 is moved to the open position, the locking region 156 engages the aperture 152 to secure the door 130 in the open position. The flexibility of the back portion 114 and the door 130 allow a user to easily disengage the aperture 152 from the locking region 156 when it is desired to move the door 130 out of the open position.

As an alternative to the aperture 152 that completely passes through the door 130, the door 130 may instead by provided with an indentation or raised region (not shown) of similar shape to the locking region 156 to secure the door when placed in the open position.

In FIGS. 1-4, the door 130 and opening 122 are illustrated near a top end of the front and back portions 112, 114 of the wiper package 110. Also included at the top end of the front and back portions 112, 114 is a hanger aperture 160 to allow hanging of the wiper package 110 on a standard hook or peg similar to those used in retail establishments to store and display items for sale.

Figure 10:
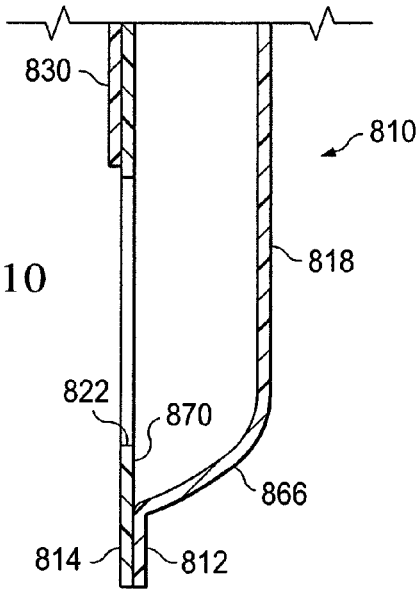
FIG. 10 depicts a cross-sectional view of the package of FIG. 9 taken at 9-9.
Figure 8:
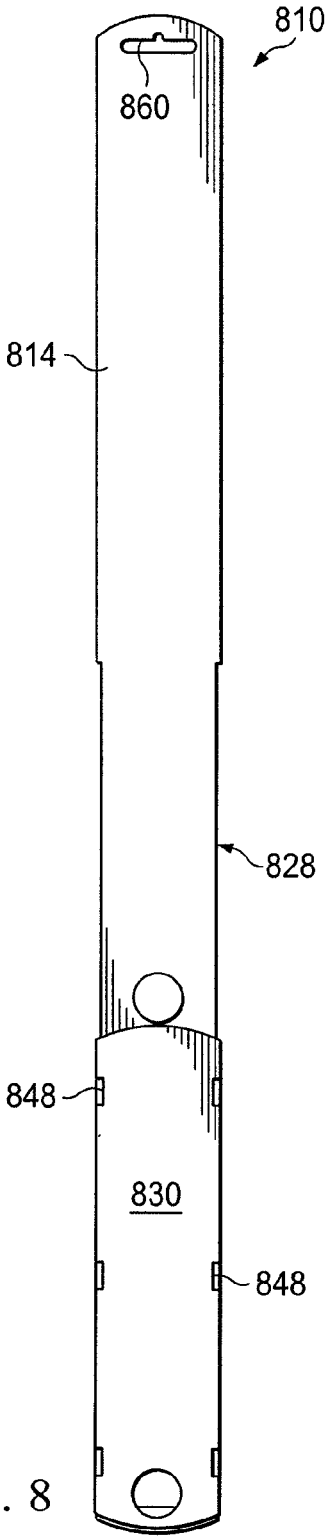
FIG. 8 depicts a rear view of a package for an elongated article according to an illustrative embodiment of the invention, the package having a door shown in a closed position.
Figure 9:
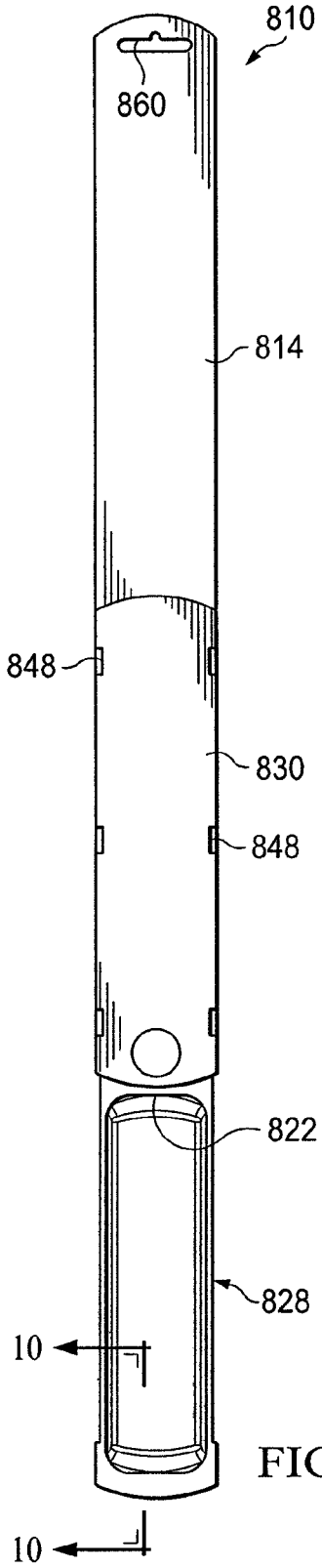
FIG. 9 illustrates a rear view of the package of FIG. 8 with the door of the package being shown in an open position.
Figure 11:
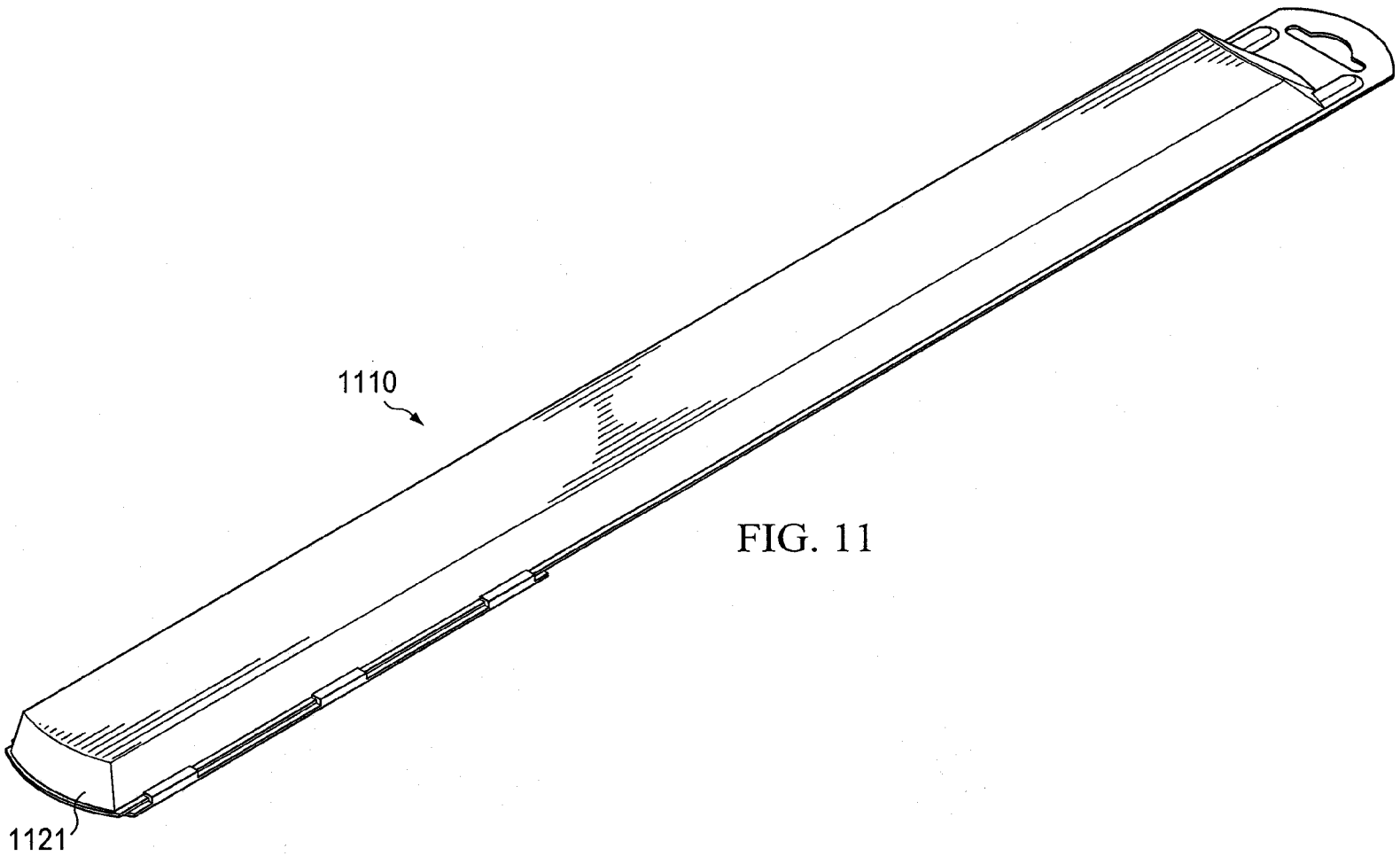
FIG. 11 illustrates a front perspective view of a package for an elongated article according to an illustrative embodiment of the invention.

Referring to FIGS. 8-10, in another embodiment, a wiper package 810 having a front portion 812, a back portion 814, a recess 818, an opening 822, a track region 828, a door 830, and hook members 848 similar to those described with reference to FIGS. 1-7 is provided. A hanger aperture 860 is disposed in the front and back portions 812, 814 at an end of the wiper package 810 opposite the opening 822 and door 830. When hung from a shelf or rack in a storage facility or store, the door 830 is located at a bottom end of the wiper package 810. One advantage to positioning the opening 822 and door 830 near the bottom end of the wiper package 810 is that the door 830 must be moved upward, against the force of gravity, to place the door 830 in an open position (see FIG. 9). The door 830 is in a closed position (see FIG. 8) when it is placed closest to the bottom end of the wiper package 810. Since the force of gravity exerts a force on the door 830 that tends to bias the door 830 into the closed position, it is less likely that the door 830 will inadvertently open and allow the contents of the wiper package 810 to fall out through the opening 822.

Other safeguards are also provided for wiper packages 110, 810 to prevent inadvertent loss of a wiper or other product through the opening. Preferably, the length of the opening is less than one-half (½) the length of the wiper package, and more preferably, less than one-third (⅓). Since the length of a windshield wiper positioned in the recess is much longer than the length of the opening, it is difficult for the wiper to "fall out of" or be pulled from the opening without at least coming into contact with the back portion. The back portion provides some interference for a wiper that is being removed from the opening. While this interference is easily overcome by a user due to the flexibility of the back portion, the interference assists in preventing a wiper from falling out of the wiper package if the door accidentally moves to the open position. The amount of interference provided to the wiper is dependent on the length of the wiper, the length of the opening, a height, H, of the recess (illustrated in FIG. 5), and the flexibility of the material used to make the wiper package. By reducing the length of the opening, the interference provided by the back portion during removal is generally increased.

Referring more specifically to FIG. 10, another feature that prevents inadvertent removal of the wiper from the wiper package 810 is the positioning of the opening 822. A lower edge of the opening 822 is positioned higher than an end wall 866 of the recess 818. This creates a lip 870 on the back portion 814 that serves as an impediment to inadvertent removal when the wiper package 810 is hanging in an upright position and the wiper is resting in the recess 818 against the end wall 866 of the recess 818.

Referring to FIGS. 11-23, an improved windshield wiper package 1110 according to an embodiment of the present invention is provided and includes an elongated front portion 1112 connected to an elongated back portion, or backing member 1114. Front portion 1112 includes a molded cavity, or recess 1118 to receive a windshield wiper that is carried by the wiper package 1110. Preferably, the front portion 1112 is a blister container that is molded or otherwise formed from a plastic or other material. The material used to form the front portion 1112 may be transparent to allow display of the package contents. The back portion 1114 is preferably also made from a plastic or other material. This material may also be transparent, or alternatively may be translucent or opaque.

Figure 12:
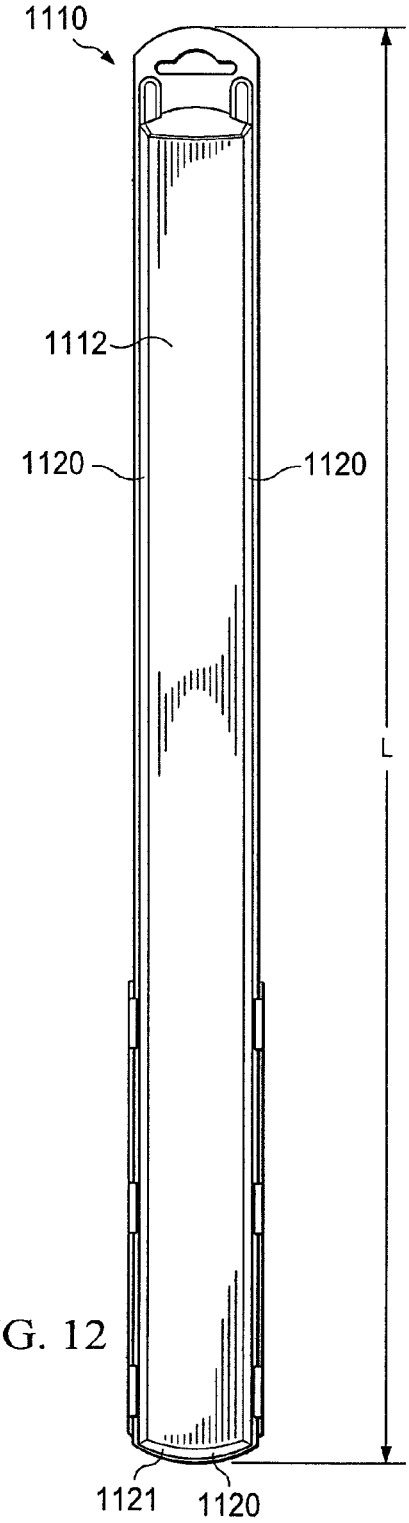
FIG. 12 depicts a front view of the package of FIG. 11.
Figure 13:
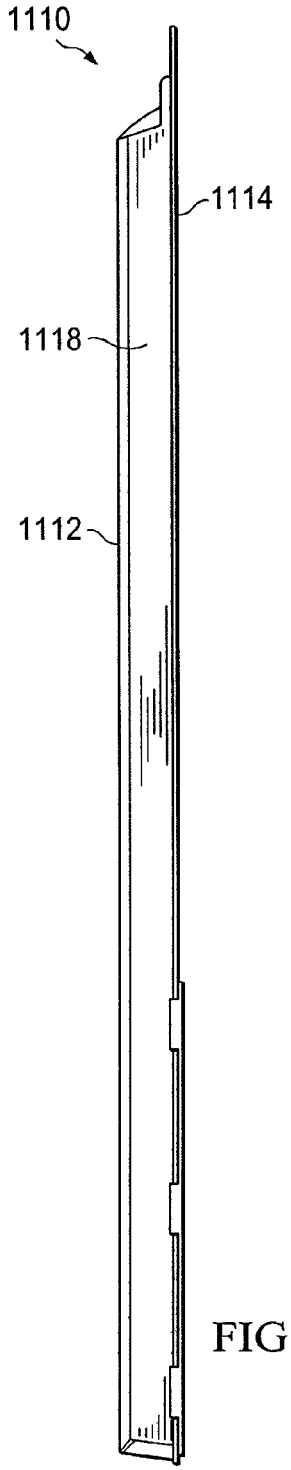
FIG. 13 illustrates a right side view of the package of FIG. 11.
Figure 14:
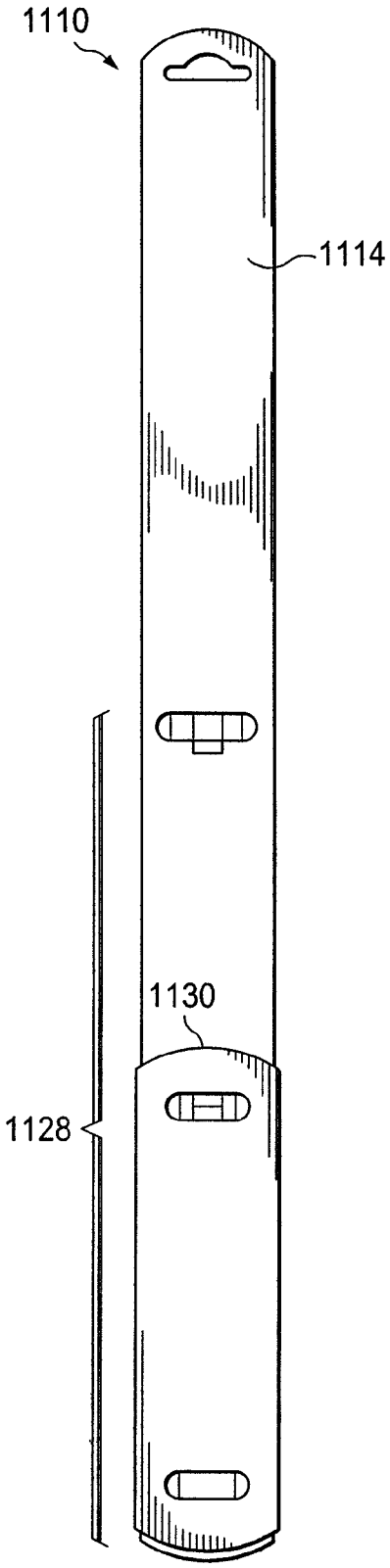
FIG. 14 depicts a rear view of the package of FIG. 11.
Figure 15:
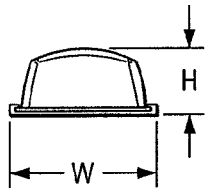
FIG. 15 illustrates a bottom view of the package of FIG. 11.

Referring more specifically to FIGS. 12 and 15, the length, L, of wiper package 1110 is substantially greater than the width, W, of the wiper package 1110. In one embodiment, the length is at least eight times greater than the width ($L \geqq 8W$), but the dimensions of the wiper package 1110 may vary depending on the size of the product to be contained within the wiper package 1110.

The recess 1118 is formed by a plurality of walls 1120 (see FIG. 12). One of the walls 1120 is a lower wall 1121 that is capable of supporting the windshield wiper when the wiper package 1110 is positioned in a substantially upright position (see FIG. 12) such as may be encountered when the wiper package 1110 is hanging from a wall or positioned on a shelf in a retail establishment. A hanger aperture similar to hanger aperture 160 (see FIG. 1) may be provided to facilitate hanging of the wiper package 1110 in the upright position.

Figure 21:
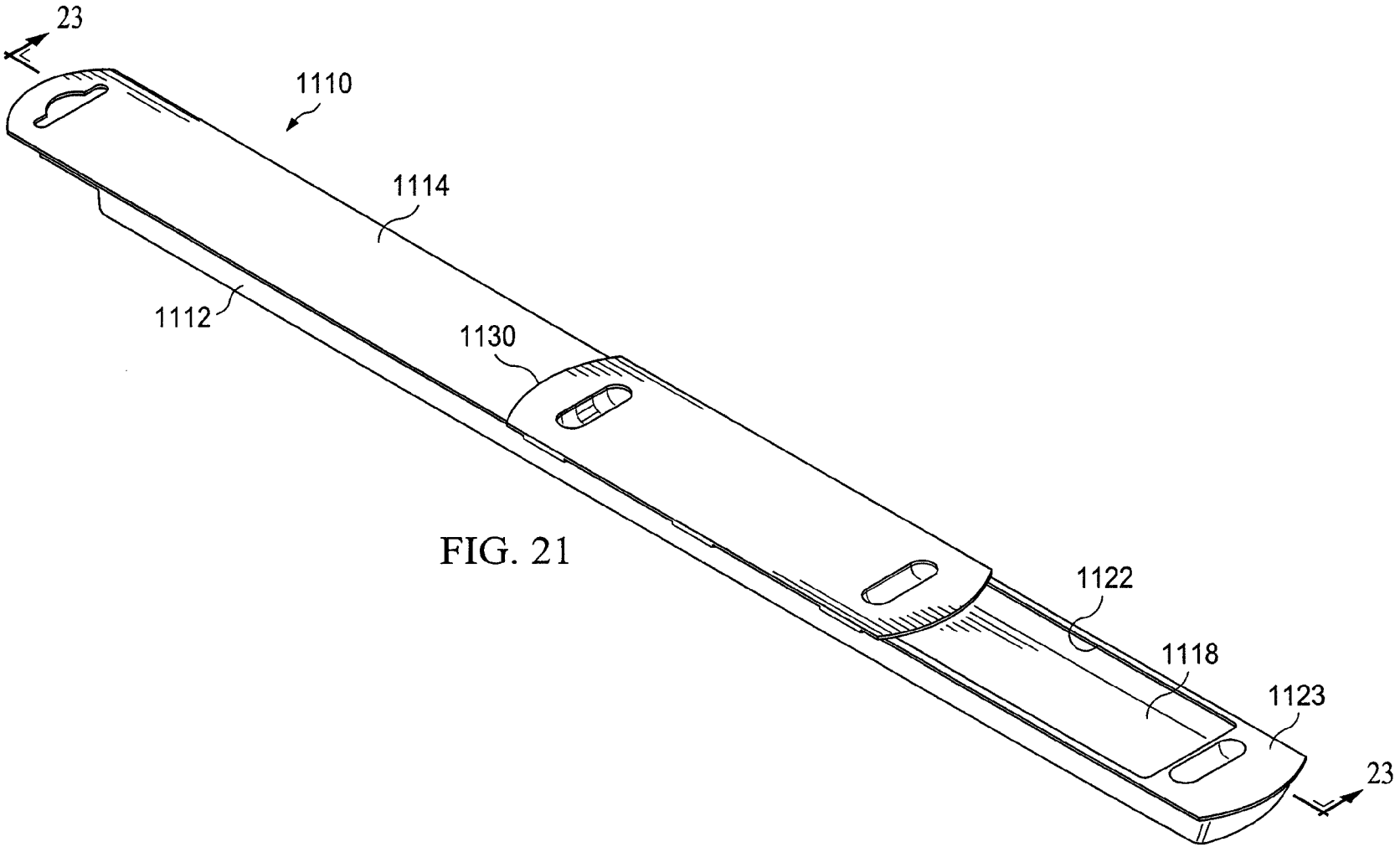
FIG. 21 illustrates a rear perspective view of the package of FIG. 11, a door of the package being shown in an open position.

An opening 1122 is provided near a bottom end of the back portion 1114. Referring more specifically to FIG. 21, the opening 1122 may be positioned on the back portion 1114 to form a retaining lip 1123 between the opening 1122 and the lower wall 1121 of the recess 1118. The retaining lip 1123 provides a barrier to substantially prevent inadvertent unloading of the windshield wiper through the opening 1122 when the wiper package 1110 is in the upright position.

A perimeter edge 1124 of the back portion 1114 includes a track region 1128 over which a door 1130 is capable of sliding. The track region 1128 could be formed with a recessed perimeter edge similar to that described above with reference to FIGS. 1-10. However, in the embodiment illustrated in FIGS. 11-23, the track region 1128 does not include a recessed perimeter edge.

The perimeter edge 1124 preferably includes a pair of longitudinal sides 1136 and a pair of lateral sides 1140 arranged in a substantially rectangular fashion. In one embodiment, the longitudinal sides 1136 may include a flange formed by either or both of the front portion 1112 and the back portion 1114. In the embodiment shown in FIGS. 11-23, the flange is disposed around the entire perimeter of the wiper package 1110 and is formed by both the front portion 1112 and the back portion 1114. The track region 1128 is located along each of the longitudinal sides 1136. The opening 1122 preferably does not extend beyond the longitudinal placement of the track region 1128, and the opening 1122 may be sized in length to be smaller than the length of the track region 1128.

Figure 18:
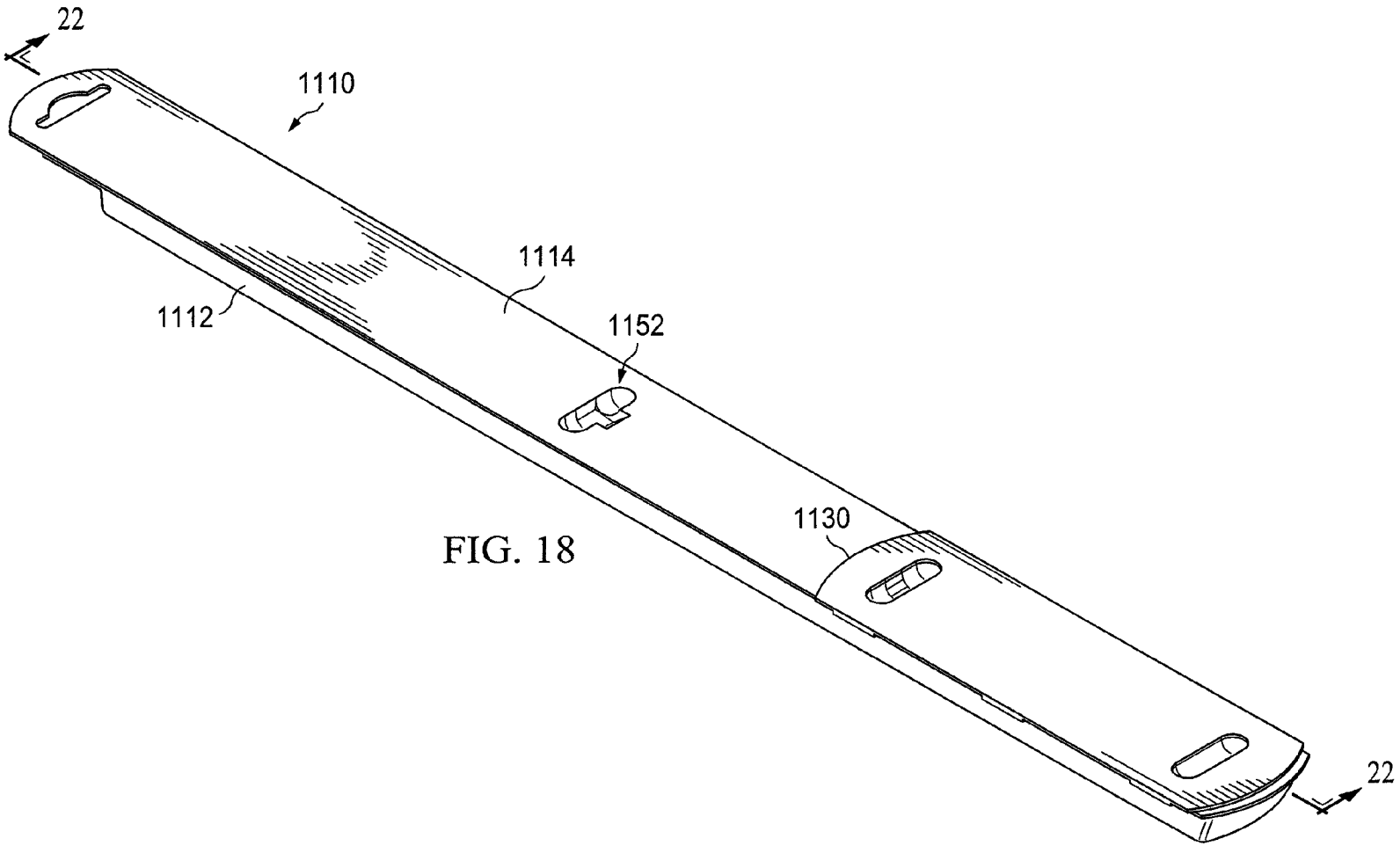
FIG. 18 depicts a rear perspective view of the package of FIG. 11, a door of the package being shown in a closed position.
Figure 19:
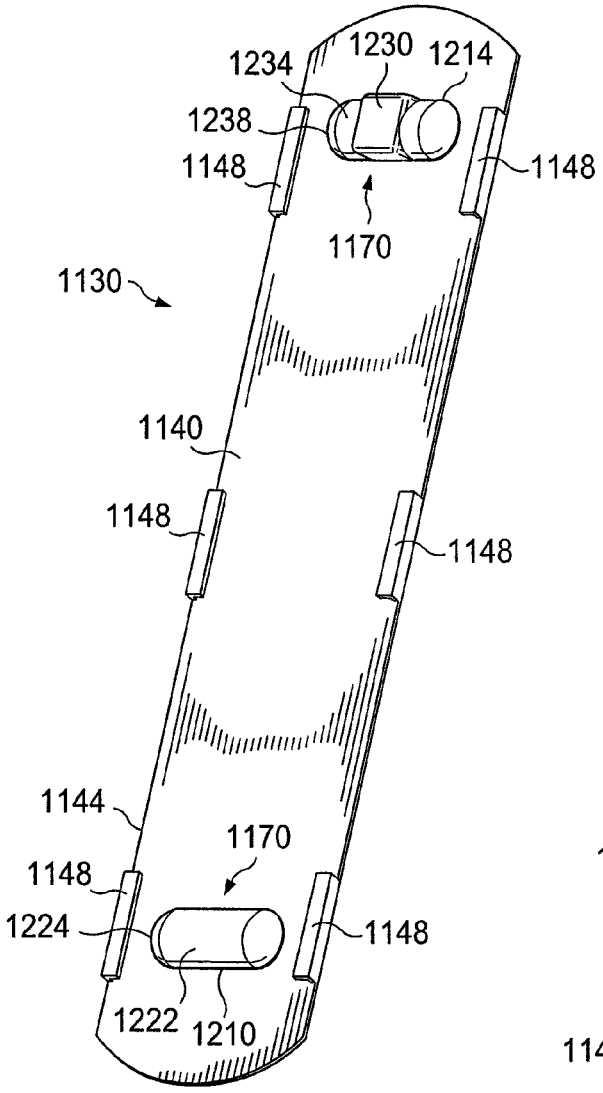
FIG. 19 illustrates a front perspective view of a door of the package of FIG. 11.
Figure 20:
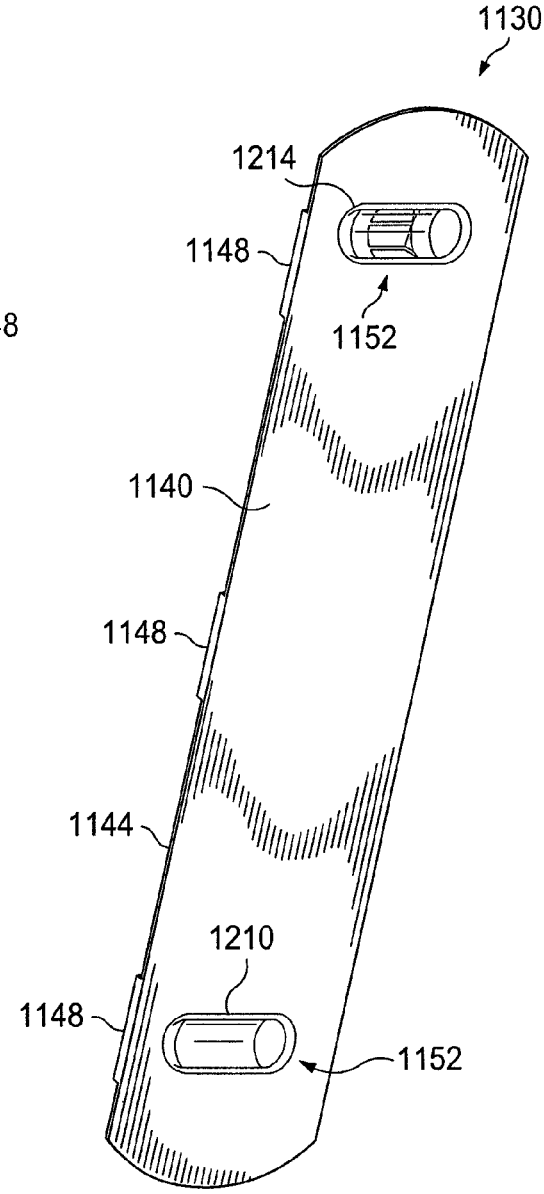
FIG. 20 depicts a rear perspective view of the door of FIG. 19.
Figure 22:
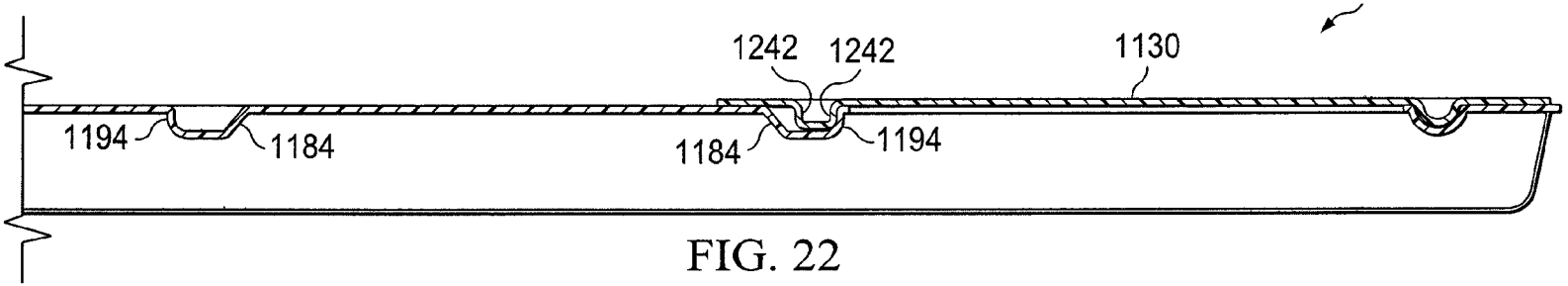
FIG. 22 depicts a cross-sectional side view of the package of FIG. 18 taken at 22-22.
Figure 23:
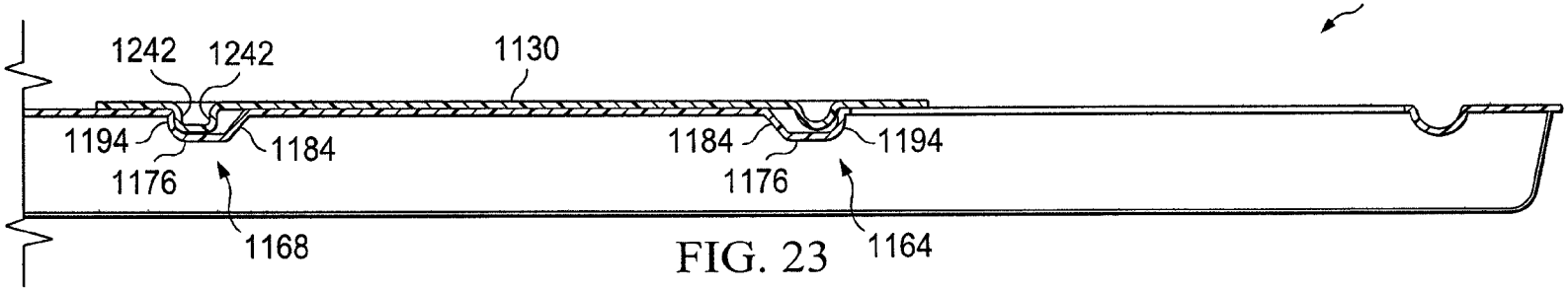
FIG. 23 illustrates a cross-sectional side view of the package of FIG. 21 taken at 23-23.

The door 1130 is slidingly received by the wiper package 1110 to allow the recess 1118 to be selectively accessed through the opening 1122. FIGS. 18 and 22 illustrate the door 1130 in a closed position, while FIGS. 21 and 23 illustrate the door 1130 in an open position. Referring more specifically to FIGS. 19 and 20, the door 1130 may include a substantially planar member 1140 having a width that is about equal to the width of the front and back portions 1112, 1114. The door 1130 may include a pair of substantially parallel longitudinal edges 1144, along which are positioned at least one hook member 1148. The hook members 1148 are slidingly received by the longitudinal sides 1136 so that the door 1130 is secured proximate the back portion 1114 of the wiper package 1110, yet allowed to slide along the longitudinal sides 1136 within the track region 1128. The hook member 1148 may have a substantially arcuate shape similar to that previously described with reference to FIGS. 5 and 6, or alternatively may have a substantially L-shaped cross section similar to that previously described with reference to FIG. 7. The longitudinal sides 1132 in the track region 1128 optionally may include ridges similar to ridges 150, or alternatively indentations, that cooperate with the hook members 1148 to aid in preventing unintentional sliding of the door 1130.

Locking means 1152 are provided on the door 1130 and the wiper package 1110 to substantially prevent unintended movement of the door 1130 from the open position to the closed position, and from the closed position to the open position. The locking means 1152 may also serve to prevent the door 1130 from moving beyond the track region 1128. In other words, the locking means 1152 prevents the door 1130 when in the open position from moving further along the longitudinal sides 1136 in a direction opposite the opening 1122. The locking means 1152 may also prevent the door 1130 when in the closed position from moving further along the longitudinal sides 1136 such that the door 1130 would become disengaged from the wiper package 1110.

Figures 16, 17:
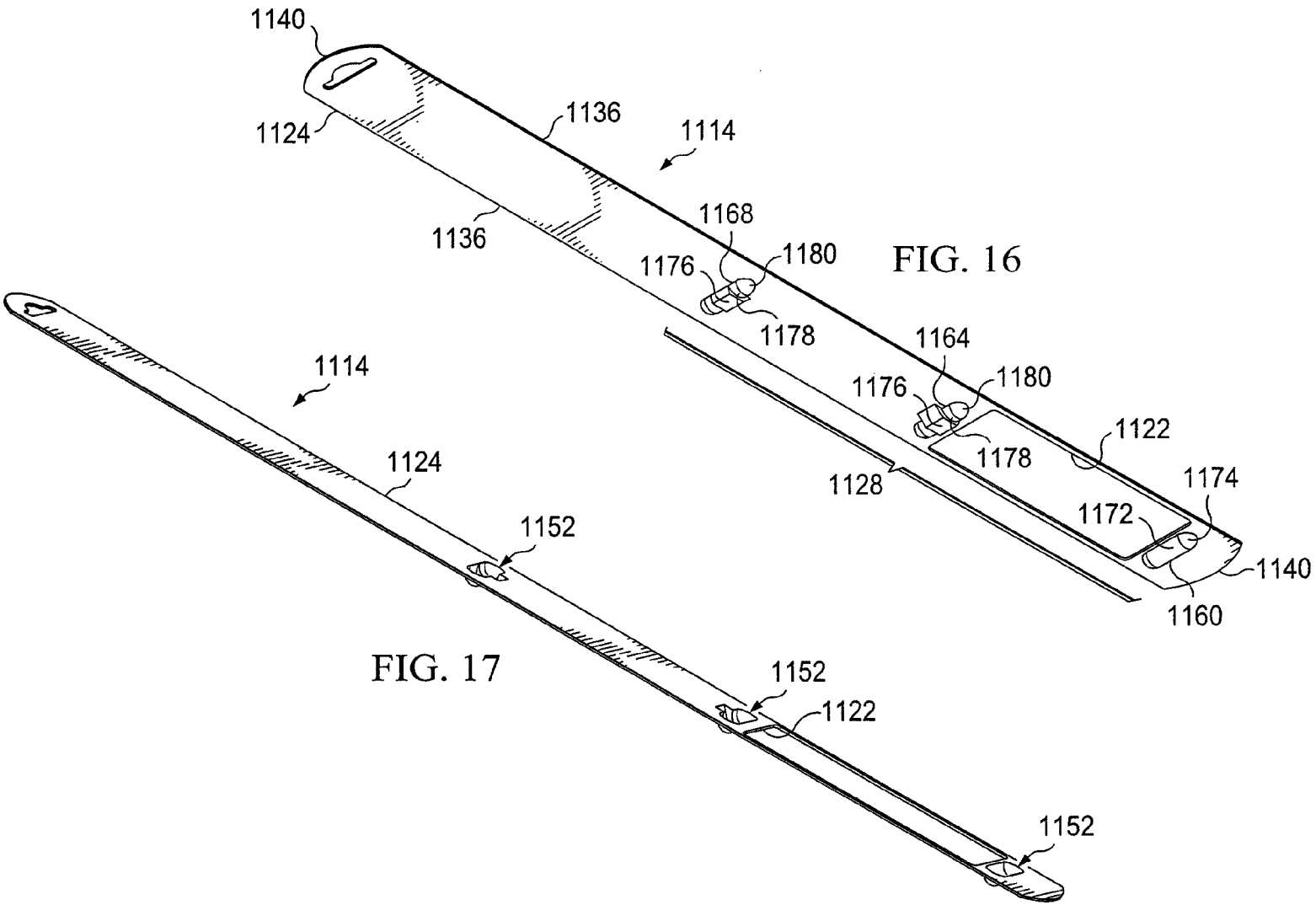
FIG. 16 depicts a front perspective view of a back portion of the package of FIG. 11.
FIG. 17 illustrates a rear perspective view of the back portion of FIG. 16.

In one embodiment, the locking means 1152 may include complimentary detents and indentations arranged on the door 1130 and the back portion 1114 of the wiper package 1110. Referring more specifically to FIGS. 16 and 17, the back portion 1114 may include a plurality of indentations 1156. In one embodiment, the indentations 1156 include a lower indentation 1160 positioned near or adjacent to a bottom end of the opening 1122 and an intermediate indentation 1164 positioned near or adjacent to an upper end of the opening 1122. An upper indentation 1168 is disposed in the back portion 1114 such that the intermediate indentation 1164 is positioned substantially between the upper indentation 1168 and the lower indentation 1160 and the distance between the upper indentation 1168 and the intermediate indentation 1164 is substantially equal to the distance between the intermediate indentation 1164 and the lower indentation 1160.

While the shape of the indentations could vary, it is preferred that the indentations 1156 be shaped in such a way that the indentations 1156 are substantially complimentary to and are capable of receiving detents 1170 positioned on the door 1130. In one embodiment, the lower indentation 1160 includes a substantially cylindrical region 1172 bounded on each end by a substantially hemispherical region 1174. Each of the intermediate indentation 1164 and the upper indentation 1168 includes a substantially rectangular cubical region 1176 disposed between two substantially cylindrical regions 1178 and two substantially hemispherical regions 1180. The term "rectangular cubical" is meant to refer to a three-dimensional shape preferably comprised of substantially rectangular sides, including cubes and other substantially rectangular or boxed shapes. Preferably, the cross-sectional area of the rectangular cubical region 1176 is sized such that the cross-sectional shape of the substantially cylindrical regions 1178 may be substantially inscribed within the cross-sectional shape of the rectangular cubical region 1176.

Referring more specifically to FIGS. 22 and 23, the substantially rectangular cubical region 1176 of the upper indentation 1168 and the intermediate indentation 1164 includes an inclined exit surface 1184. The inclined exit surface 1184 of the intermediate indentation 1164 is positioned on a side of the substantially rectangular cubical region 1176 nearest the upper indentation 1168 and is inclined toward the upper indentation 1168. The inclined exit surface 1184 of the upper indentation 1168 is positioned on a side of the substantially rectangular cubical region 1176 nearest the intermediate indentation 1164 and is inclined toward the intermediate indentation 1164.

The substantially rectangular cubical regions 1176 of the upper indentation 1168 and the intermediate indentation 1164 further include a keeper surface 1194. The keeper surface 1194 of the intermediate indentation 1164 is positioned on a side of the substantially rectangular cubical region 1176 nearest the lower indentation 1160 and may be substantially normal to the back portion 1114. The keeper surface 1194 of the upper indentation 1168 is positioned on a side of the substantially rectangular cubical region 1176 opposite the inclined exit surface 1184 and may be substantially normal to the back portion 1114. The keeper surfaces 1194 provide for positive locking and securement of the door 1130 when the door 1130 is in the open position or closed position by preventing the door 1130 from moving outside of the track region 1128.

Referring more specifically to FIGS. 19 and 20, the detents 1170 positioned on the door 1130 preferably include a lower detent 1210 and an upper detent 1214. The lower detent 1210 is shaped and sized to fit in a complimentary fashion into the lower indentation 1160 when the door 1130 is closed or the intermediate indentation 1164 when the door 1130 is open. The lower detent 1210 includes a substantially cylindrical region 1222 bounded on each end by a substantially hemispherical region 1224. Due to the sizing of the rectangular cubical region 1176, when the door 1130 is in an open position, the lower detent 1210 is able to fit within the intermediate indentation 1164 without interference between the lower detent 1210 and the rectangular cubical region 1176.

The upper detent 1214 is shaped and sized to fit in a complimentary fashion into the intermediate indentation 1164 when the door 1130 is closed or the upper indentation 1168 when the door 1130 is open. The upper detent 1214 includes a substantially rectangular cubical region 1230 disposed between two substantially cylindrical regions 1234 and two substantially hemispherical regions 1238. One difference between the cross-sectional shapes of the substantially rectangular cubical region 1176 (of the indentations 1164, 1168) and the substantially rectangular cubical region 1230 (of the upper detent 1214) is that the substantially rectangular cubical region 1230 does not include an inclined surface that is complimentary to the inclined exit surface 1184. Instead, the substantially rectangular cubical region 1230 includes surfaces 1242 (see FIGS. 22 and 23) that are substantially parallel to one another and substantially normal to the back portion 1114.

Referring to FIGS. 22 and 23, the interaction of the surfaces 1242 and the inclined exit surfaces 1184 allows the door 1130 to be selectively moved from an open position to a closed position, or vice versa. When the door 1130 is in the closed position, the keeper surface 1194 of the intermediate indentation 1164 engages one of the surfaces 1242 of the upper detent 1214 to prevent further movement of the door 1130 toward the lower end of the wiper package 1110. When the door 1130 is in the open position, the keeper surface 1194 of the upper indentation 1168 engages one of the surfaces 1242 of the upper detent 1214 to prevent further movement of the door 1130 toward the upper end of the wiper package 1110.

In one embodiment, movement of the door 1130 from one position to another requires some elastic deformation of either the door 1130 or the back portion 1114. As the door 1130 is moved from one of the open and closed positions, the deformation allows the detents 1210, 1214 to move out of the indentations and onto the back portion 1114. As the door approaches the other of the open and closed positions, the deformation rebounds causing the detents 1210, 1214 to again be seated in the indentations.

The opening 1122 of wiper package 1110 is similar in size and positioning to the opening described in FIGS. 8-10. These similarities provide the safeguards described previously for preventing inadvertent loss of the wiper from the wiper package 1110. While not limited in size, in one embodiment, a maximum length of the wiper package 1110 is about thirty-one (31) inches and a minimum length of the wiper package is about eighteen (18) inches. In one illustrative embodiment, the dimensions of the opening 1122 may be about 1.7 inches in width and about 5 inches in length.

In one illustrative example, the wiper package 1110 may be sized such that wipers of various lengths may be accepted and contained by the wiper package 1110. Table 1 illustrates several non-limiting examples of dimensions that may associated with a wiper package and the wiper carried by the wiper package.

TABLE 1

| Wiper Length (in) | Wiper Package Length (in) | Opening Length (in) |
|---|---|---|
| 11 to 15 | 18.3 | 5.0 |
| 16 to 20 | 23.2 | 5.0 |

TABLE 1-continued

| Wiper Length (in) | Wiper Package Length (in) | Opening Length (in) |
|---|---|---|
| 21 to 24 | 26.8 | 5.0 |
| 25 to 28 | 31.0 | 5.0 |

Even though many of the examples discussed herein involve elongated packages used to contain windshield wipers, the packages described may be used to house or contain any elongated article. Moreover, while the door that allows loading or unloading of the package has been described as having hook member or other means that wrap around or otherwise cooperate with a track, the edge of the door could function as a track that is received by hook members or other means that are position on the front and/or back portions of the package.

It should be apparent from the foregoing that an invention having significant advantages has been provided. While the invention is shown in only a few of its forms, it is not just limited but is susceptible to various changes and modifications without departing from the spirit thereof.

We claim:

1. A windshield wiper package for containing a windshield wiper, the wiper package comprising:

a front portion having a recess for receiving the windshield wiper;

a back portion connected to the front portion for containing the windshield wiper within the recess;

an opening disposed in the back portion to allow loading or unloading of the windshield wiper, the opening being sized such that a length of the opening is less than about one-third of a length of the wiper package;

a door slidingly received by the back portion such that the door can be moved between an open position and a closed position; and complimentary detents and indentations for securing the door in the open position and the closed position, the detents positioned on one of the back portion and the door, the indentations positioned on another of the back portion and door;

wherein at least one of the detents engages one of the indentations in the closed position;

wherein the at least one of the detents engages another of the indentations in the open position.

2. The windshield wiper package of claim 1, wherein the length of the opening relative to the length of the package prevents the windshield wiper from inadvertently moving through the opening.

3. The windshield wiper package of claim 1, wherein the indentations further comprise:

a lower indentation disposed on the back portion proximate a bottom end of the opening;

an intermediate indentation disposed on the back portion proximate an upper end of the opening; and an upper indentation disposed on the back portion such that the intermediate indentation is positioned substantially between the upper indentation and the lower indentation.

4. The windshield wiper package of claim 3, wherein the detents further comprise:

a lower detent disposed on the door and configured to engage the lower indentation when the door is in the closed position and the intermediate indentation when the door is in the open position; and an upper detent disposed on the door and configured to engage the intermediate indentation when the door is in the closed position and the upper indentation when the door is in the open position.

5. A windshield wiper package for containing a windshield wiper, the package comprising:

a cavity for receiving the windshield wiper, the cavity have a plurality of walls, at least one of the walls being a lower wall to support the windshield wiper when the package is oriented in an upright position;

a backing member to substantially enclose the cavity;

a hanger aperture disposed in an upper end of the backing member;

an opening disposed in the backing member at a bottom end of the backing member to allow loading or unloading of the windshield wiper, the opening being positioned on the backing member to form a retaining lip between the opening and the lower wall;

a door slidingly received by the backing member and being capable of sliding between an open position and a closed position; and locking means associated with the door and the backing member to substantially secure the door in the open position or the closed position;

wherein the retaining lip provides a barrier to substantially prevent inadvertent unloading of the windshield wiper through the opening when the package is in the upright position.

6. The windshield wiper package of claim 5, wherein:

the opening is sized such that a length of the opening is less than about one-third of a length of the package; and the length of the opening relative to the length of the package prevents the windshield wiper from inadvertently moving through the opening.

7. The windshield wiper package of claim 5, wherein the locking means further comprises complimentary detents and indentations for securing the door in the open position or the closed position, the detents positioned on one of the backing member and the door, the indentations positioned on another of the backing member and door.

8. The windshield wiper package of claim 7, wherein the indentations further comprise:

a lower indentation disposed on the backing member proximate a bottom end of the opening;

an intermediate indentation disposed on the backing member proximate an upper end of the opening; and an upper indentation disposed on the backing member such that the intermediate indentation is positioned substantially between the upper indentation and the lower indentation.

9. The windshield wiper package of claim 8, wherein the detents further comprise:

a lower detent disposed on the door and configured to engage the lower indentation when the door is in the closed position and the intermediate indentation when the door is in the open position; and an upper detent disposed on the door and configured to engage the intermediate indentation when the door is in the closed position and the upper indentation when the door is in the open position.

10. A windshield wiper package for containing a windshield wiper, the wiper package comprising:

a front portion having a recess for receiving the windshield wiper;

a back portion connected to the front portion for containing the windshield wiper within the recess;

an opening disposed in the back portion to allow loading or unloading of the windshield wiper, the opening being sized such that a length of the opening is less than about one-third of a length of the wiper package;

a door slidingly received by the back portion such that the door can be moved between an open position and a closed position; and complimentary detents and indentations for securing the door in the open position and the closed position, the detents positioned on only one of the back portion and the door, the indentations positioned on another of the back portion and door.

11. The windshield wiper package of claim 10, wherein the length of the opening relative to the length of the package prevents the windshield wiper from inadvertently moving through the opening.

12. The windshield wiper package of claim 10, wherein the indentations further comprise:

a lower indentation disposed on the back portion proximate a bottom end of the opening;

an intermediate indentation disposed on the back portion proximate an upper end of the opening; and an upper indentation disposed on the back portion such that the intermediate indentation is positioned substantially between the upper indentation and the lower indentation.

13. The windshield wiper package of claim 12, wherein the detents further comprise:

a lower detent disposed on the door and configured to engage the lower indentation when the door is in the closed position and the intermediate indentation when the door is in the open position; and an upper detent disposed on the door and configured to engage the intermediate indentation when the door is in the closed position and the upper indentation when the door is in the open position.

* * * * *